US007530571B1

(12) United States Patent
Bell

(10) Patent No.: US 7,530,571 B1
(45) Date of Patent: May 12, 2009

(54) SQUARE PEG ROUND HOLE GAME

(76) Inventor: Goldie F. Bell, 1 Las Moradas Cir., San Pablo, CA (US) 94806

( * ) Notice: Subject to any disclaimer, the term of this patent is extended or adjusted under 35 U.S.C. 154(b) by 37 days.

(21) Appl. No.: 11/458,949

(22) Filed: Oct. 30, 2006

(51) Int. Cl.
*A63F 3/00* (2006.01)

(52) U.S. Cl. ..... 273/264; 273/287; 273/236; 273/271

(58) Field of Classification Search ..... 273/236, 273/264, 271, 440, 281, 287
See application file for complete search history.

(56) References Cited

U.S. PATENT DOCUMENTS 1,848,598 A * 3/1932 Barnes ..... 434/259
4,019,741 A 4/1977 Herriman
4,239,230 A 12/1980 Shoptaugh
5,560,605 A 10/1996 Garcia et al.
6,142,786 A * 11/2000 Culberson et al. ..... 434/258

FOREIGN PATENT DOCUMENTS

DE 29715750 U1 * 10/1997
GB 2114008 A * 8/1938

* cited by examiner

*Primary Examiner*—Vishu K. Mendiratta
(74) *Attorney, Agent, or Firm*—Daniel R. Richardson

(57) ABSTRACT

The present invention is a strategy game involving the insertion of square pegs into the three round holes on each game box playing surface. The three holes are circular and are placed on the left side, right side and toward the topmost edge away from the player and centered between the left and right peg holes. The play proceeds by choosing a square peg from the central pool of play pegs and attempting to fit the square peg into one of the unoccupied circular game box holes, by proceeding from left to right to top. The first player to fill all three holes wins the round and is awarded the available points for their game box holes and peg points from the other players. The player accumulating 6,000 points, wins the game.

9 Claims, 2 Drawing Sheets

SQUARE PEG ROUND HOLE GAME

CROSS-REFERENCE TO RELATED APPLICATIONS

N/A

FEDERALLY SPONSORED RESEARCH

N/A

SEQUENCE LISTING OR PROGRAM

N/A

BACKGROUND OF THE INVENTION

1. Overview

The present invention is a strategy game involving the insertion of square pegs into the round holes on the game surfaces of the rectangular game boxes. There are a number of prior art games involving boards and the insertion of pegs. The prior art games each use a plurality of different shaped holes in the game board and usually round pegs of varying lengths for insertion into the board holes.

2. Prior Art

The U.S. Pat. No. 5,560,605, registered Oct. 1, 1996 by Filadelfo Garcia, et. al., discloses a strategy game with a stationary platform that incorporates three peg cavities for inserting a set of three pegs, and a set of seven disks each with a different diameter. The game starts with all of the disks on a single peg arranged by diameter with the largest diameter disk on the bottom. The strategy goal is to move the same configuration of disks to another peg without putting a disk with a larger diameter over a disk with a smaller diameter.

The U.S. Pat. No. 4,019,741, registered Apr. 26, 1977 by Straud D. Harriman, discloses a game of the peg-board type having levered means for ejecting playing piece dowels from predetermined playing surface holes upon the insertion of another playing piece in another predetermined hole of play. The game employs round dowels as playing pieces.

The U.S. Pat. No. 4,239,230, registered Dec. 16, 1980 by Phillip L. Shoptaugh, discloses a board game that includes a plurality of three different kinds of playing pieces and a board having playing fields thereon adapted to receive each kind of playing piece. Two of the kinds of playing pieces are designed to be simultaneously played on any playing field and to be moved independently of each other to other playing fields. The third kind of playing piece is adapted to block the playing of one of the other kinds of playing pieces and to be blocked by such kind of playing piece depending on which is played first. The playing pieces are round and of several different diameters.

PREFERRED EMBODIMENT

The present invention is completely new and unique over the prior art as set forth. In the present invention, the rectangular game box is three-dimensional with round holes in the top game surface to receive square pegs.

The game play begins with each player having a game box 10. The total number of 60 pegs, both the 10 pegs that fit game box holes 30 and the remaining 50 pegs that don't fit game box holes 40, are freely intermixed and placed in a central location, between the game players, near the game boxes 10. Each game player has a game box 10. The game play consists in each game player taking a turn, turns being taken counter-clockwise around the group of players. The first turn for the game consists in all the players first taking four pegs from the central location. The next step in the first turn is for one player to take one of their pegs and attempt to fit into the 500 point, leftmost peg hole 15.

Proceeding counter-clockwise, the next player attempts to fit one of their pegs into the 500 point, leftmost peg hole 15. Play proceeds until all four pegs of the first draw from the central location have been tried and points, if any logged on the player score sheet 60.

The next active player then selects a single peg from the central location and attempts to place the selected peg into an unoccupied peg hole, starting with the leftmost peg hole 15 and continuing to the rightmost peg hole 20 and finally to the topmost peg hole 25. If the player's peg does not fit, play proceeds counter-clockwise to the next player until all the holes on the player's game box game surface are filled, completing a round of play. At the end of the round, the player who first filled all three holes on their game box 10 gets not only the 3,000 points for doing that, but also the unused peg points (10 points for each unused peg) from the other players to yield the round total 70, which is entered on the round winner's score sheet 60. The round winner cannot use any of their own unused peg points. The other players yield their peg totals 60 to the round winner and all the game boxes 10 are then emptied of any pegs in the game boxes 10.

On completion of the round of play, all the pegs retained by the players after their attempts to fit into the game surface are then returned to the central location and mixed again. The play then proceeds as before, round by round until a single player reaches a total for all rounds of 6,000 or more points. The first player to accumulate 6,000 or more points is the game winner.

DRAWINGS

Figures

REFERENCE NUMERALS

Figure 1:
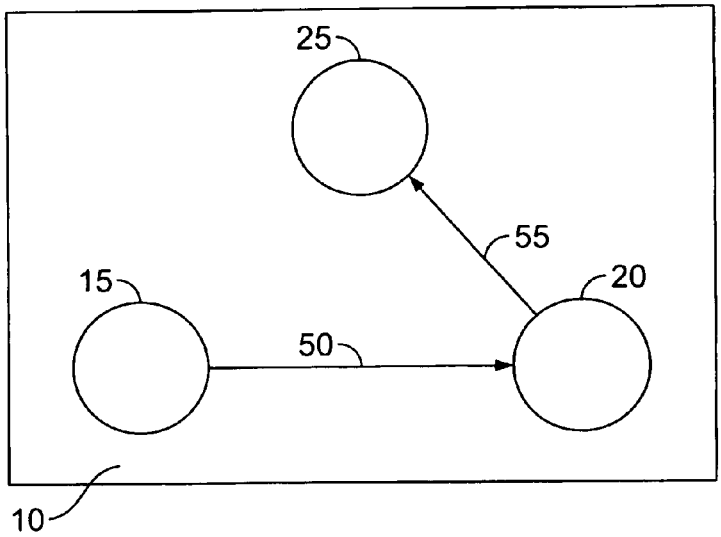
FIG. 1 depicts the game surface as used in the present invention

10 game box being almost as thick as the length of a game peg, allowing the peg to be exposed above the top of the game box 10 peg holes 15, 20 and 25, and may be made of a variety of materials such as plastic or wood

15 leftmost peg hole being circular and placed toward the left edge of the game box 10 and of a diameter sufficient to accept a peg that fits game box hole 30, and of sufficient depth to allow an inserted peg that fits game box hole 30 to protrude above the top surface of the game box 10 to allow grasping by a player's thumb and finger (points award 500)

20 rightmost peg hole being circular and placed toward the right edge of the game box 10 and of a diameter sufficient to accept a peg that fits game box hole 30, and of sufficient depth to allow an inserted peg that fits game box hole 30 to protrude above the top surface of the game box 10 to allow grasping by a player's thumb and finger (points award 1000)

25 topmost peg hole being circular and placed toward the top edge of the game box 10 and of a diameter sufficient to accept a peg that fits game box hole 30, and of sufficient depth to allow an inserted peg that fits game box hole 30 to protrude above the top surface of the game box 10 to allow grasping by a player's thumb and finger, and being centered between the leftmost peg hole 15 and the rightmost peg hole 20 (points award 1,500)

30 peg that fits game box hole consisting of individual square-shaped pegs, being of a length on each side that allows the peg to fit inside the game box 10 peg holes 15, 20 and 25, and of sufficient length to protrude above the top surface of the game box 10 to allow grasping by a player's thumb and finger

40 peg that doesn't fit game box hole consisting of individual square-shaped pegs, being of a length on each side that will not allow the peg to fit inside the game box 10 peg holes 15, 20 and 25, and of the same overall length as the pegs that fit game box holes 30.

50 line pointer leftmost to rightmost on the game box indicates the direction of play from the leftmost peg hole 15 to the rightmost peg hole 20.

55 line pointer rightmost to topmost on the game box indicates the direction of play from the rightmost peg hole 20 to the topmost peg hole 25.

60 score sheet for each player to keep track of score based on peg that fits game box hole 30 yielding peg totals 62 and for round totals 68 and game totals 70

62 peg total the score is based on the number of pegs that are remaining from each player after a given round of play

64 board totals the number of points awarded based on filling all the leftmost opening 15, the rightmost opening 20 and the topmost opening 25

66 player name is the name of the player for this score sheet 60

68 round total is the total points awarded this player for a round of play

70 game total is the total points awarded on this score sheet 60 to the player for the entire game

DETAILED DESCRIPTION

Figures

FIG. 1 depicts the game box 10, showing the leftmost peg hole 15, the rightmost peg hole 20 and the topmost peg hole 25. There is a convenient line pointer leftmost to rightmost 50 showing the movement of play from the leftmost peg hole 15 to the rightmost peg hole 20. Likewise, there is also a line pointer rightmost to topmost 55 showing the movement of play from the rightmost peg hole 20 to the topmost peg hole 25. These line pointers (50 and 55) are a helpful visual for the players.

Figure 2:
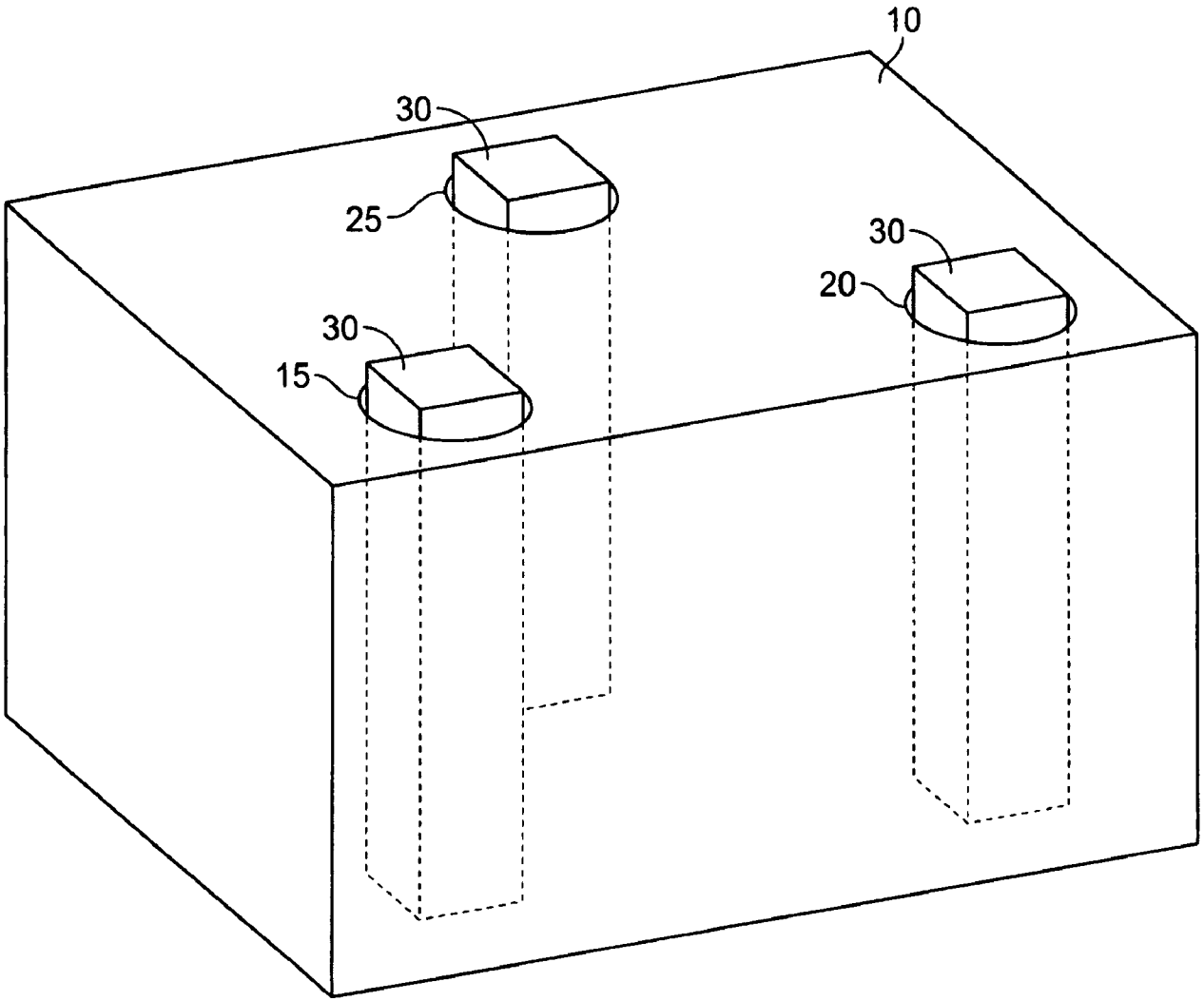
FIG. 2 shows the three-dimensional game box with pegs inserted into all three holes

FIG. 2 depicts the game box 10, from the side, indicating its three-dimensional characteristic, and showing the leftmost peg hole 15, the rightmost peg hole 20 and the topmost peg hole 25 on the top surface of the game box 10. Also shown are pegs that fit game box holes 30 in each of the game holes (15, 20 and 25).

Figure 3:
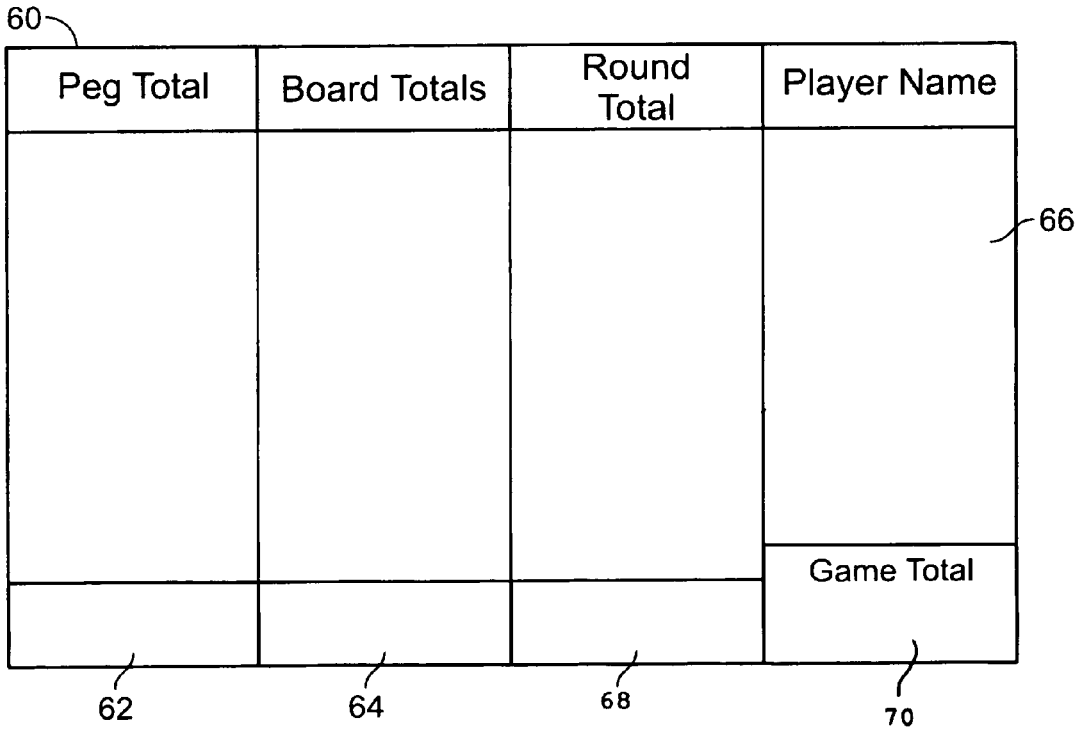
FIG. 3 shows the score card used by players to track their progress

FIG. 3 depicts the game sheet 60 as used by a player of the game to keep track of their score as the game progresses. The top left portion of the game sheet 60 shows the peg total 62, reflecting the score based on the number of pegs that fits game box hole 30 as placed in a given round of play. Continuing from left to right, the next column is board totals 64 that is used to capture the number of points awarded based on filling either the leftmost opening 15, the rightmost opening 20 or the topmost opening 25. The next column to the right, "Round Total" 68 shows the total points awarded this player for a round of play. The rightmost column shows the "Player name" 66, which is the name of the player for this score sheet. Finally, in the lower part of the rightmost column is the place for entry of the game total 70, which is the total points awarded this player on score sheet 60 for the entire game.

I claim:

1. A game for at least two players, comprising:

A rectangular game box with a top game surface having three uniformly formed circular holes each with a depth just slightly less than the length of a square game piece peg;

said game box having the first circular hole being disposed toward the bottom left side of the top game surface of said game box, the second circular hole being disposed toward the right side of said game surface, in line with the leftmost circular hole, and with an arrow painted on said game surface from the leftmost circular hole and continuing to the rightmost circular hole with the arrowhead terminating at the center edge of the rightmost circular hole, and with the third circular hole being disposed toward the edge of said game surface farthest away from and centered between said leftmost and rightmost circular holes with an arrow painted on said game surface from the rightmost circular hole and continuing to said farthest game surface edge circular hole with the arrowhead terminating at the downward right edge of said farthest edge circular hole;

a plurality of square game piece pegs with a uniform length and a dimension from one square point to the opposite square point that is slightly less than the diameter of said three circular holes on said game surface of said game box so as to fit inside a circular hole on said game surface of said game box; and a plurality of square game piece pegs with a uniform length and a dimension from one square point to the opposite square point that is slightly larger than the diameter of said three circular holes on said game surface of said game box so as not to fit inside a circular hole on said game surface of said game box.

2. The game according to claim 1 wherein said game box is hollow.

3. The game according to claim 1 wherein said game box is solid.

4. The game according to claim 1 wherein said circular holes on said game surface are of the same diameter.

5. The game according to claim 1 wherein said circular holes on said game surface are of different diameters.

6. The game according to claim 1 wherein said arrows are inscribed on said game surface.

7. The game according to claim 1 wherein said arrows are pre-printed on said game surface.

8. A method of playing a game by at least two players on the top game surface of a rectangular game box having three formed circular holes in said game surface, one disposed toward the left side of said game surface, one disposed toward the right side of said game surface, having an arrow between the leftmost and rightmost circular holes with the arrowhead terminating on the leftmost edge of the rightmost circular hole, and a third circular hole disposed toward the farthest edge and centered between the closer two holes and having an arrow on said game surface from the rightmost circular hole to the farthest centered circular hole, with the arrowhead on said arrow terminating at the right downward side of the farthest centered circular hole, a plurality of square game piece pegs with a uniform length and a dimension from one square point to the opposite square point that is slightly less than the diameter of said three circular holes on said game surface of said game box so as to fit inside a circular hole on said game surface of said game box, and a plurality of square game piece pegs with a uniform length and a dimension from one square point to the opposite square point that is slightly larger than the diameter of said three circular holes on said game surface of said game box so as not to fit inside a circular hole on said game surface of said game box, comprising:

(a) All square game pegs are placed in a central location and thoroughly mixed;

(b) Each game player having a rectangular game box with a game surface;

(c) In the first turn of the game all players take four game pegs from the central location, play begins with selections from these first four game pegs, and when exhausted, continues with single selections from the central location;

(d) One player begins a round by randomly selecting a square game peg and attempting to fit it into the first available circular opening, starting from left to right then to the farthest centered circular hole;

(e) If the player's game peg does not fit, the turn continues to the next player, counter-clockwise from the present player;

(f) If the player's game peg fits into a circular hole, the leftmost hole counts as 500 points, the rightmost hole counts as 1,000 points and the farthest, centered hole counts as 1,500 points;

(g) The turns continue until one player fills all three holes on their own game surface, this concludes a round, and the player first filling all three holes gets the total of 3,000 points plus the unused peg points for that round accumulated by all the other players;

(h) Play continues with step (a) above, until one player meets or exceeds 6,000 points, at which event, the game concludes.

9. The method of claim 8, wherein there are 10 square game pegs that fit said circular holes on said game surface and there are 50 square game pegs that do not fit said circular holes on said game surface.

* * * * *